US009852706B2

(12) United States Patent
Wang et al.

(10) Patent No.: US 9,852,706 B2
(45) Date of Patent: Dec. 26, 2017

(54) THIN FILM TRANSISTOR ARRAY SUBSTRATE, DISPLAY PANEL THEREON, AND METHOD OF TESTING SINGLE COLOR IMAGE OF DISPLAY PANEL

(71) Applicant: Century Technology (Shenzhen) Corporation Limited, Shenzhen (CN)

(72) Inventors: Ming-Tsung Wang, New Taipei (TW); Chih-Chung Liu, New Taipei (TW); Yang Zhao, Shenzhen (CN); Zhi-Hong Chang, Shenzhen (CN)

(73) Assignee: Century Technology (Shenzhen) Corporation Limited, Shenzhen (CN)

( * ) Notice: Subject to any disclaimer, the term of this patent is extended or adjusted under 35 U.S.C. 154(b) by 0 days.

(21) Appl. No.: 15/077,147

(22) Filed: Mar. 22, 2016

(65) Prior Publication Data

US 2017/0116940 A1 Apr. 27, 2017

(30) Foreign Application Priority Data

Oct. 21, 2015 (CN) ..... 2015 1 0696175

(51) Int. Cl.
*G09G 3/36* (2006.01)

(52) U.S. Cl.
CPC ... *G09G 3/3648* (2013.01); *G09G 2300/0452* (2013.01); *G09G 2300/0478* (2013.01); *G09G 2300/08* (2013.01)

(58) Field of Classification Search
CPC ..... G09G 3/3648; G09G 2300/0452; G09G 2300/0478; G09G 2300/08
USPC ..... 345/88
See application file for complete search history.

(56) References Cited

U.S. PATENT DOCUMENTS

| | | | | |
|---|---|---|---|---|
| 6,246,074 | B1 * | 6/2001 | Kim | G01R 31/021 257/350 |
| 2008/0068524 | A1 * | 3/2008 | Kim | G02F 1/136286 349/38 |
| 2011/0221719 | A1 * | 9/2011 | Kim | G09G 3/3648 345/205 |
| 2015/0123882 | A1 * | 5/2015 | Hsu | G09G 3/006 345/55 |
| 2016/0055781 | A1 * | 2/2016 | Phan | G09G 3/2003 345/690 |

* cited by examiner

*Primary Examiner* — Stephen Sherman
(74) *Attorney, Agent, or Firm* — Steven Reiss

(57) ABSTRACT

A TFT array substrate which includes a plurality of pixels arranged in a matrix, has each pixel including sub-pixels in a 2×2 matrix. Two data lines are between neighboring columns of the sub-pixels and scan line is arranged between neighboring rows of the sub-pixels. The sub-pixels in same row can be electrically coupled to one scan line. The sub-pixels for the same color in one same column can be electrically coupled to the neighboring data line. The sub-pixels configured to display another same color in the same column can be electrically coupled to another neighboring same data line. Each two adjacent sub-pixels displaying a same color have opposite polarities.

16 Claims, 5 Drawing Sheets

THIN FILM TRANSISTOR ARRAY SUBSTRATE, DISPLAY PANEL THEREON, AND METHOD OF TESTING SINGLE COLOR IMAGE OF DISPLAY PANEL

CROSS-REFERENCE TO RELATED APPLICATIONS

This application claims priority to Chinese Patent Application No. 201510696175.5 filed on Oct. 21, 2015, the contents of which are incorporated by reference herein.

FIELD

The present disclosure relates to display panels, and particularly to a thin film transistor (TFT) array substrate, for a display panel having a TFT array substrate, and a method of testing single color image of a display panel.

BACKGROUND

TFT display panels have become popular since they have advantages of compactness, low heat generation, long life, and ease of viewing. In general a display panel includes a backlight module, a first polarizer, a TFT array substrate, a color filter, and a second polarizer. The TFT array substrate forms a plurality of pixels thereon. Each pixel includes three sub-pixels, i.e., a red sub-pixel, a green sub-pixel, and a blue sub-pixel. For such an RGB TFT display panel, the backlight module consumes inordinate amounts of power in order to have sufficient light passing through the color filter.

An RGBW TFT display panel, in which each pixel includes a red sub-pixel, a green sub-pixel, a blue sub-pixel, and a white sub-pixel, avoids some disadvantages of the RGB TFT display panel. A transparent area corresponding to a white sub-pixel is defined in the color filter, whereby light transmittance of the color filter is improved, and the amount of power consumed by the backlight module can be reduced.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustrating the principles of the disclosure. Moreover, in the drawings, like reference numerals designate corresponding parts throughout the several views.

DETAILED DESCRIPTION

Figure 1:
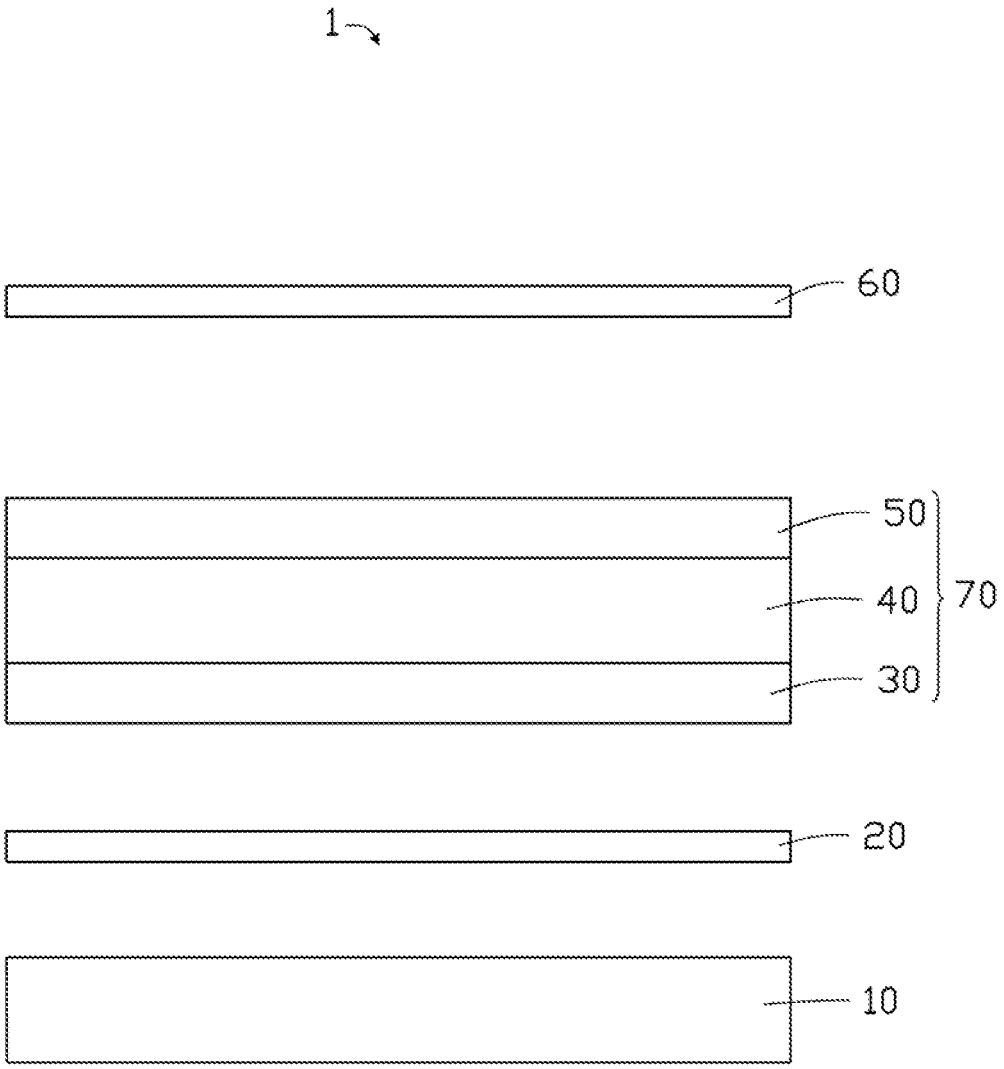
FIG. 1 is an exploded, cross-sectional view of a display panel in accordance with the present disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape, or other feature that the term modifies, such that the component need not be exact. For example, "substantially cylindrical" means that the object resembles a cylinder, but can have one or more deviations from a true cylinder. The term "comprising" means "including, but not necessarily limited to"; it specifically indicates open-ended inclusion or membership in a so-described combination, group, series and the like.

The present disclosure is described in relation to an RGBW (red-green-blue-white) display panel, which can be used in a display screen, for example the screen of a smart phone, a monitor of a computer, a screen of a laptop, a screen of a television set, or a screen of a tablet computer. The display panel can be a Liquid Crystal Display (LCD) panel or an Organic Light Emitting Display (OLED) panel.

FIG. 1 illustrates an embodiment of a display panel 1, which is a LCD panel. The display panel 1 can have, from the base to the top, a backlight module 10, a first polarizer 20, a thin film transistor (TFT) array substrate 30, a liquid crystal layer 40, a color filter 50, and a second polarizer 60. The TFT array substrate 30, the liquid crystal layer 40, the color filter 50, and a driver circuit assembly (not shown) in combination construct an LCD module 70.

The backlight module 10 can include a plurality of light emitting diodes (LEDs) or a plurality of cold cathode fluorescent lamps (CCFLs) as a light source for generating white light emitted through the first polarizer 20, the TFT array substrate 30, the liquid crystal layer 40, the color filter 50, and the second polarizer 60. The first polarizer 20 can polarize the light, which means that only orthogonal light is allowed to pass through the first polarizer 20 to reach the TFT array substrate 30. The liquid crystal layer 40 can include a plurality of liquid crystal molecules therein. An arrangement of the liquid crystal molecules can be changed in accordance with a change of a bias across the liquid crystal layer 40, to adjust the amount of light passing through the liquid crystal layer 40. In the illustrated embodiment, the color filter 50 is an RGBW color filter and has a plurality of pixels, each pixel a green sub-pixel, a red sub-pixel, a blue sub-pixel, and a white sub-pixel. The white sub-pixels are transparent whereby the light passing through the color filter 50 is increased. In comparison with an RGB color filter, the power needed by the backlight module 10 is decreased. The function of the second polarizer 60 can be similar to that of the first polarizer 20 and it allows only orthogonal light to pass through.

Figure 2:
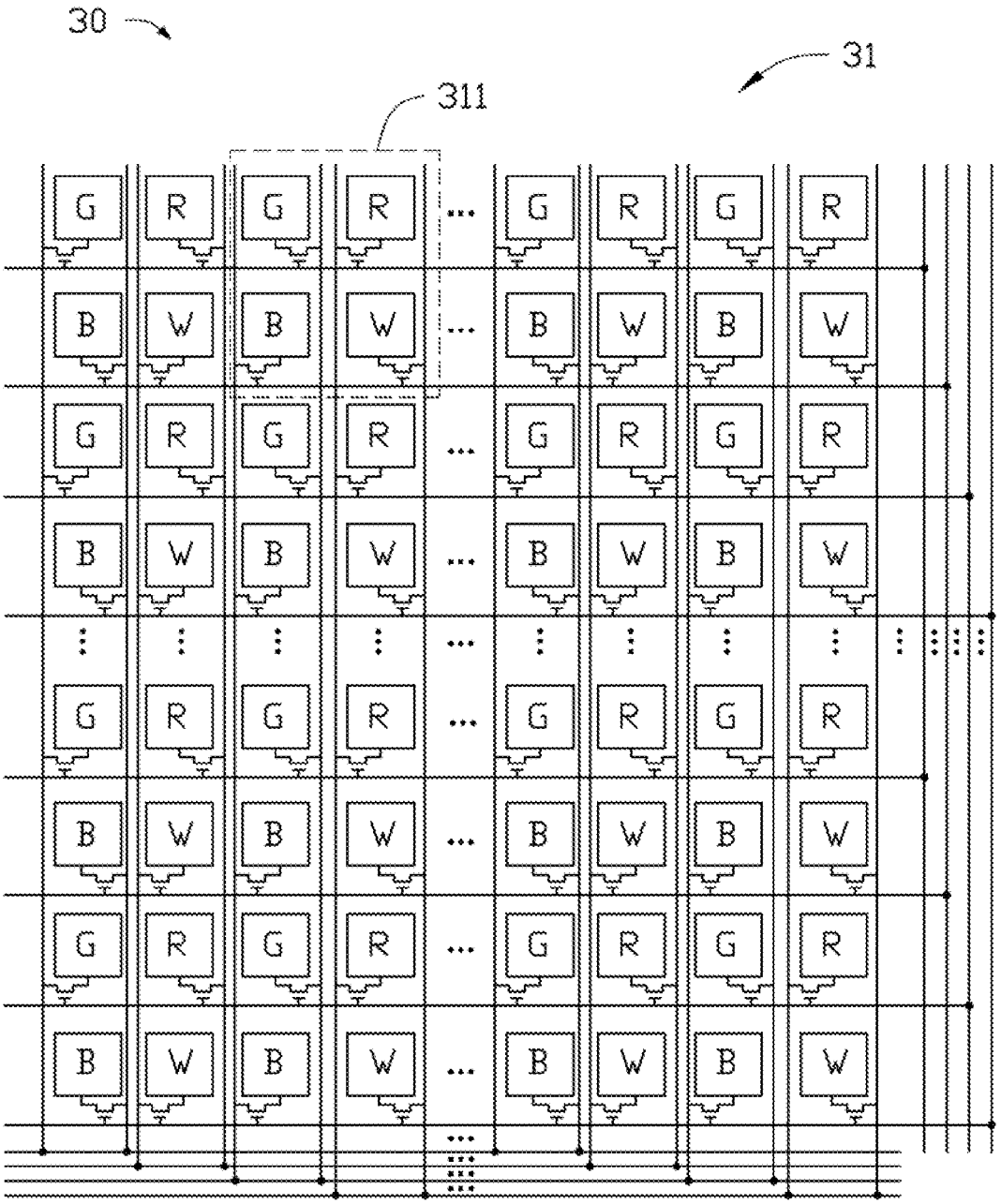
FIG. 2 is a schematic diagram of a TFT array substrate of the display panel of FIG. 1.

FIG. 2 illustrates an equivalent circuit 31 of the TFT array substrate 30 of the display panel 1. The circuit 31 can include a plurality of pixels 311 arranged in a matrix, such as a 1920×1080 matrix of 5.5 inches in size.

Figure 3:
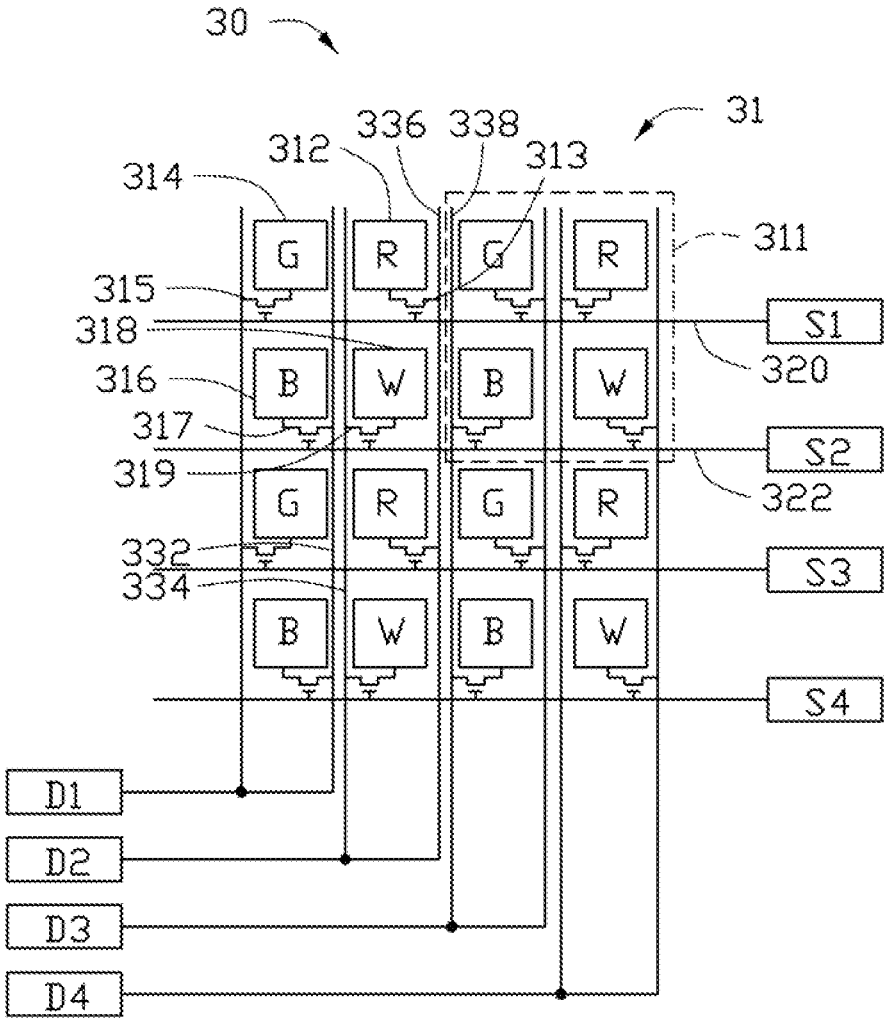
FIG. 3 is a schematic diagram of the TFT array substrate of the display panel of FIG. 1 in concordance with a first embodiment of the present disclosure.

For the sake of illustration, FIG. 3 illustrates a pixel array of a 2×2 matrix. In fact, the actual pixel array can be more than the 2 rows and/or 2 columns shown in FIG. 2.

Each pixel 311 consists of a red sub-pixel 312, a green sub-pixel 314, a blue sub-pixel 316, and a white sub-pixel 318. The four sub-pixels 312, 314, 316, and 318 are arranged in a substantially square matrix (i.e., 2×2 matrix). The red and green sub-pixels 312, 314 can be arranged as green-red pairs along one row (i.e., an odd row) and the blue and white sub-pixels 316, 318 can be arranged as blue-white pairs along a neighboring or an adjacent row (i.e., an even row). Thus the red and white sub-pixels 312, 318 can be arranged as red-white pairs in one column (i.e., an even column) and the green and blue sub-pixels 314, 316 arranged as green-blue pairs in a neighboring or an adjacent column (i.e., an odd column). In their row, the red and green sub-pixels 312, 314 alternate, and the blue and white sub-pixels 316, 318 also alternate. In their respective columns, the red and white sub-pixels 312, 318 alternate, and the green and blue sub-pixels 314, 316 also alternate.

In a vertical direction, a data line 332 and a data line 334 are arranged between some adjacent columns of sub-pixels of each pixel column. Thus, the data line 332 and the data line 334 are located between the sub-pixels 312, 314, 316, and 318 of the pixel 311. Another two data lines 336, 338 are arranged between the next adjacent columns of pixels. Thus, the data line 336 and the data line 338 are located between adjacent pixels along the row. A horizontal first scan line 320 is arranged between adjacent rows of sub-pixels of each pixel. Thus, the first scan line 320 is located between sub-pixels 312, 314, 316, and 318 of the pixel 311. A horizontal second scan line 322 is arranged between adjacent rows of pixels. Thus, the second scan line 322 is located between adjacent pixels along the column. The first and second scan lines 320, 322 can be orthogonal to the data lines 332, 334, 336, 338. The data lines 332, 334, 336, 338 and the scan lines 320, 322 are electrically coupled to the red sub-pixel 312, the green sub-pixel 314, the blue sub-pixel 316, and the white sub-pixel 318.

For example, the red sub-pixel 312 of a first pixel (i.e., the pixel towards top left corner of the circuit 31 shown in FIG. 3) can be electrically coupled to the first scan line 320 and the data line 336 via a thin film transistor (TFT) 313. The TFT 313 can have a source electrode (not labeled) electrically coupled with the data line 336, a gate electrode (not labeled) coupled with the first scan line 320, and a drain electrode (not labeled) coupled with a pixel electrode (not labeled) of the red sub-pixel 312. The red sub-pixel 312 of a second pixel (i.e., the pixel at top right corner of the circuit 31 shown in FIG. 3), arranged in same row as the first pixel, can be electrically coupled to the first scan line 320 and the data line 334 adjacent to the red sub-pixel 312 via a thin film transistor (TFT). The red sub-pixels 312 of other pixels in same row as the first and second pixels can be electrically coupled to the first scan line 320 and one of the data lines 334, 336 in a similar way as with the red sub-pixel of the first pixel and the red sub-pixel of the second pixel. The red sub-pixel 312 of a third pixel (i.e. the pixel towards bottom left corner of the circuit 31 shown in FIG. 3), arranged in same column as the first pixel, can be electrically coupled to the first scan line 320 and the data line 336 adjacent to the red sub-pixel 312 via a thin film transistor (TFT). The red sub-pixel 312 of a fourth pixel (i.e., the pixel towards bottom right corner of the circuit 31 shown in FIG. 3), arranged in same column as the second pixel, can be electrically coupled to the first scan line 320 and the data line 334 adjacent to the red sub-pixel 312 via a thin film transistor (TFT). The red sub-pixels 312 of other pixels in same row as the third and fourth pixels can be electrically coupled to the first scan line 320 and one of the data lines 334, 336 in a similar way as with the red sub-pixel 312 of the third pixel and the red sub-pixel 312 of the fourth pixel.

Thus, the red sub-pixels 312 of the pixels of odd columns can be each electrically coupled to the first scan line 320 and the adjacent data line 336, and the red sub-pixels of the pixels of even columns can be each electrically coupled to the first scan line 320 and the adjacent data line 334.

The green sub-pixel 314 of the first pixel can be electrically coupled to the first scan line 320 and the adjacent data line 338 via a thin film transistor (TFT) 315. The TFT 315 can have a source electrode coupled with the data line 338, a gate electrode coupled with the first scan line 320, and a drain electrode coupled with a pixel electrode of the green sub-pixel 314. The green sub-pixel 314 of the second pixel, which arranged in a neighboring same row of the first pixel, can be electrically coupled to the first scan line 320 and the data line 332 adjacent to the green sub-pixel 314 via a thin film transistor (TFT). The green sub-pixels 314 of other pixels in same row as the first and second pixel can be electrically coupled to the first scan line 320 and one of the data lines 338, 332 in a similar way as with the green sub-pixel of the first pixel and the green sub-pixel of the second pixel. The green sub-pixel 314 of the third pixel, which arranged in a neighboring same column of the first pixel, can be electrically coupled to the first scan line 320 and the data line 338 adjacent to the green sub-pixel via a thin film transistor (TFT). The green sub-pixel 314 of the fourth pixel, arranged in same column as the second pixel, can be electrically coupled to the first scan line 320 and the data line 332 adjacent to the green sub-pixel via a thin film transistor (TFT). The green sub-pixels 314 of other pixels in same row as the third and fourth pixels can electrically coupled to the first scan line 320 and one of the data lines 338, 332 in a similar way as with the green sub-pixel of the third pixel and the green sub-pixel of the fourth pixel.

Thus, the green sub-pixels of the pixels of odd columns can be each electrically coupled to the first scan line 320 and the adjacent data line 338, and the green sub-pixels of the pixels of even columns can be each electrically coupled to the first scan line 320 and the adjacent data line 332.

The blue sub-pixel 316 of the first pixel can be electrically coupled to the second scan line 322 and the adjacent data line 332 via a thin film transistor (TFT) 317. The TFT 317 can have a source electrode coupled with the data line 332, a gate electrode coupled with the second scan line 322, and a drain electrode coupled with a pixel electrode of the blue sub-pixel 316. The blue sub-pixel 316 of the second pixel, arranged in same row as the first pixel, can be electrically coupled to the second scan line 322 and the data line 338 adjacent to the blue sub-pixel 316 via a thin film transistor (TFT). The blue sub-pixels 316 of other pixels in same row as the first and second pixels can be electrically coupled to the second scan line 322 and one of the data lines 332, 338 in a similar way as with the blue sub-pixel of the first pixel and the blue sub-pixel of the second pixel. The blue sub-pixel 316 of the third pixel, arranged in same column as the first pixel, can be electrically coupled to the second scan line 322 and the data line 332 adjacent to the blue sub-pixel via a thin film transistor (TFT). The blue sub-pixel 316 of the fourth pixel, arranged in same column as the second pixel, can be electrically coupled to the second scan line 322 and the data line 338 adjacent to the blue sub-pixel via a thin film transistor (TFT). The blue sub-pixels 316 of other pixels in same row as the third and fourth pixels can electrically coupled to the second scan line 322 and one of the data lines 332, 338 in a similar way as with the blue sub-pixel of the third pixel and the blue sub-pixel of the fourth pixel.

Thus, the blue sub-pixels of the pixels of odd columns can be each electrically coupled to the second scan line 322 and the adjacent data line 332, and the blue sub-pixels of the pixels of even columns can be each electrically coupled to the second scan line 322 and the adjacent data line 338.

The white sub-pixel 318 of the first pixel can be electrically coupled to the second scan line 322 and the adjacent data line 334 via a thin film transistor (TFT) 319. The TFT 319 can have a source electrode coupled with the data line 334, a gate electrode coupled with the second scan line 322, and a drain electrode coupled with a pixel electrode of the white sub-pixel 318. The white sub-pixel 318 of the second pixel, arranged in same row as the first pixel, can be electrically coupled to the second scan line 322 and the data line 336 adjacent to the white sub-pixel 318 via a thin film transistor (TFT). The white sub-pixels 318 of other pixels in same row as the first and second pixels can be electrically coupled to the second scan line 322 and one of the data lines 334, 336 in a similar way as with the white sub-pixel of the first pixel and the white sub-pixel of the second pixel. The white sub-pixel 318 of the third pixel, arranged in same column of the first pixel, can be electrically coupled to the second scan line 322 and the data line 334 adjacent to the white sub-pixel via a thin film transistor (TFT). The white sub-pixel 318 of the fourth pixel, arranged in same column as the second pixel, can be electrically coupled to the second scan line 322 and the data line 336 adjacent to the white sub-pixel via a thin film transistor (TFT). The white sub-pixels 318 of other pixels in same row as the third and fourth pixels can electrically coupled to the second scan line 322 and one of the data lines 334, 336 in a similar way as with the white sub-pixel of the third pixel and the white sub-pixel of the fourth pixel.

Thus, the white sub-pixels of the pixels of odd columns can be each electrically coupled to the second scan line 322 and the adjacent data line 334, and the white sub-pixels of the pixels of even columns can be each electrically coupled to the second scan line 322 and the adjacent data line 336.

The green sub-pixels 314 of the first and third pixels can be electrically coupled to the data line 338. The green sub-pixels 314 of the first and third pixels, and the blue sub-pixels 316 in same column as the green sub-pixels 314 of the first and third pixels can be electrically coupled to the data line 332. The data line 338 coupling with the green sub-pixels 314 of the first column of the pixels 311, and the data line 332 coupling with the blue sub-pixels 316 of the first column of the pixels 311 can be coupled to a node coupling with a first data test point D1. The green sub-pixels 314 of the second and fourth pixels can be coupled to the data line 332. The green sub-pixels 314 of the second and fourth pixels, and the blue sub-pixels 316 of the second and fourth pixels, can be electrically coupled to the data line 338. The data line 332 coupling with the green sub-pixels 314 of the second and fourth pixels and the data line 338 coupling with the blue sub-pixels 316 of the second and fourth pixels can be coupled to a node in electrical coupling with a third data test point D3. Similarly, other pixels 311 can be in same electrical coupling relationship as the above. Such as, the data line 338 in electrical coupling with the green sub-pixels 314 of the pixels of an odd column, and the data line 332 in electrical coupling with the blue sub-pixels 316 of the pixels of the odd column can be in electrical coupling with the first data test point D1. The data line 332 coupling with the green sub-pixels 314 of the pixels of an even column, and the data line 338 in electrical coupling with the blue sub-pixels 316 of the pixels of the even column can be in electrical coupling with the third data test point D3.

The red sub-pixels 312 of the first and third pixels can be electrically coupled to the data line 336. The red sub-pixels 312 of the first and third pixels, and the white sub-pixels 318 in same column as the red sub-pixels 312 of the first and third pixels can be electrically coupled to the data line 334. The data line 336 coupling with the red sub-pixels 312 of the first column of the pixels 311, and the data line 334 coupling with the white sub-pixels 318 of the first column of the pixels 311 can be coupled to a node in electrical coupling with a second data test point D2. The red sub-pixels 312 of the second and fourth pixels can be electrically coupled to the data line 334. The red sub-pixels 312 of the second and fourth pixels, and the white sub-pixels 318 of the second and fourth pixels can be electrically coupled to the data line 336. The data line 334 in electrical coupling with the red sub-pixels 312 of the second and fourth pixels and the data line 336 in electrical coupling with the white sub-pixels 318 of the second and fourth pixels can be coupled to a node in electrical coupling with a fourth data test point D4. Similarly, other pixels 311 can be in same electrical coupling relationship as the above. Such as, the data line 336 in electrical coupling with the red sub-pixels 312 of the pixels of an odd column, and the data line 334 in electrical coupling with the white sub-pixels 318 of the pixels of the odd column can be in electrical coupling with the second data test point D2. The data line 334 in electrical coupling with the red sub-pixels 312 of the pixels of an even column, and the data line 336 in electrical coupling with the white sub-pixels 318 of the even column can be in electrical coupling with the fourth data test point D4.

The green sub-pixel 314 of the first pixel can be coupled to the first scan line 320 in electrical coupling with a first scan test point S1. The blue sub-pixel 316 of the first pixel can be coupled to the second scan line 322 in electrical coupling with a second scan test point S2. The green sub-pixel 314 of the third pixel can be coupled to the first scan line 320 in electrical coupling with a third scan test point S3. The blue sub-pixel 316 of the third pixel can be coupled to the second scan line 322 in electrical coupling with a fourth scan test point S4. For other pixels, the coupling relationship can be similar. Such as, the first scan line 320 in electrically coupling with the green and red sub-pixels of the pixels of an odd row can be coupled with a first scan test point S1, and the first scan line 320 in electrically coupling with the green and red sub-pixels of the pixels of an even row can be coupled with a third scan test point S3. The second scan line 322 in electrically coupling with the blue and white sub-pixels of the pixels of an odd row can be coupled with a second scan test point S2, and the second scan line 322 in electrically coupling with the blue and white sub-pixels of the pixels of an even row can be coupled with a fourth scan test point S4.

In the illustrated embodiment, the sub-pixels which are in connection with a same data line of the data lines 332, 334, 336, and 338 have a same polarity (either positive electrode or negative electrode).

Figure 4:
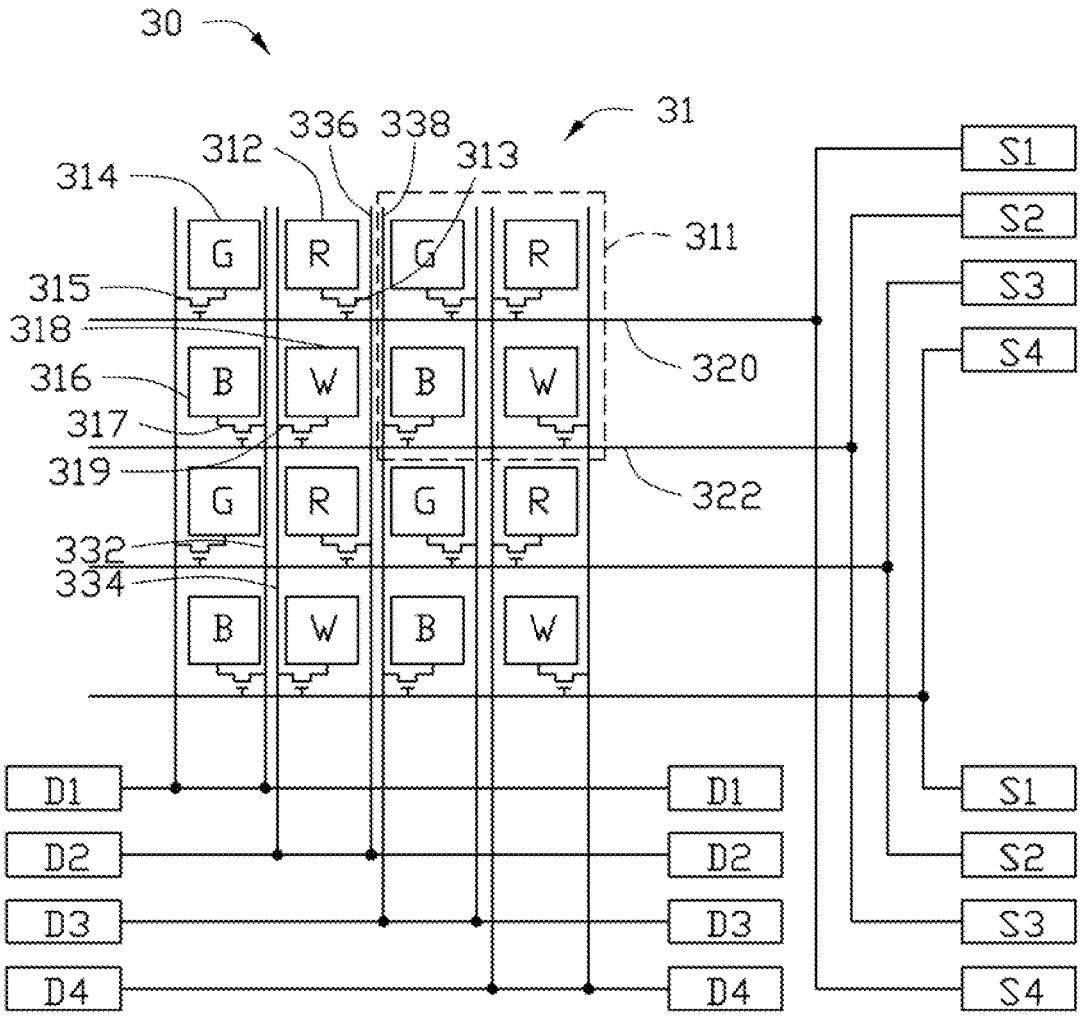
FIG. 4 is a schematic diagram of the TFT array substrate of the display panel of FIG. 1 in concordance with a second embodiment.
Figure 5:
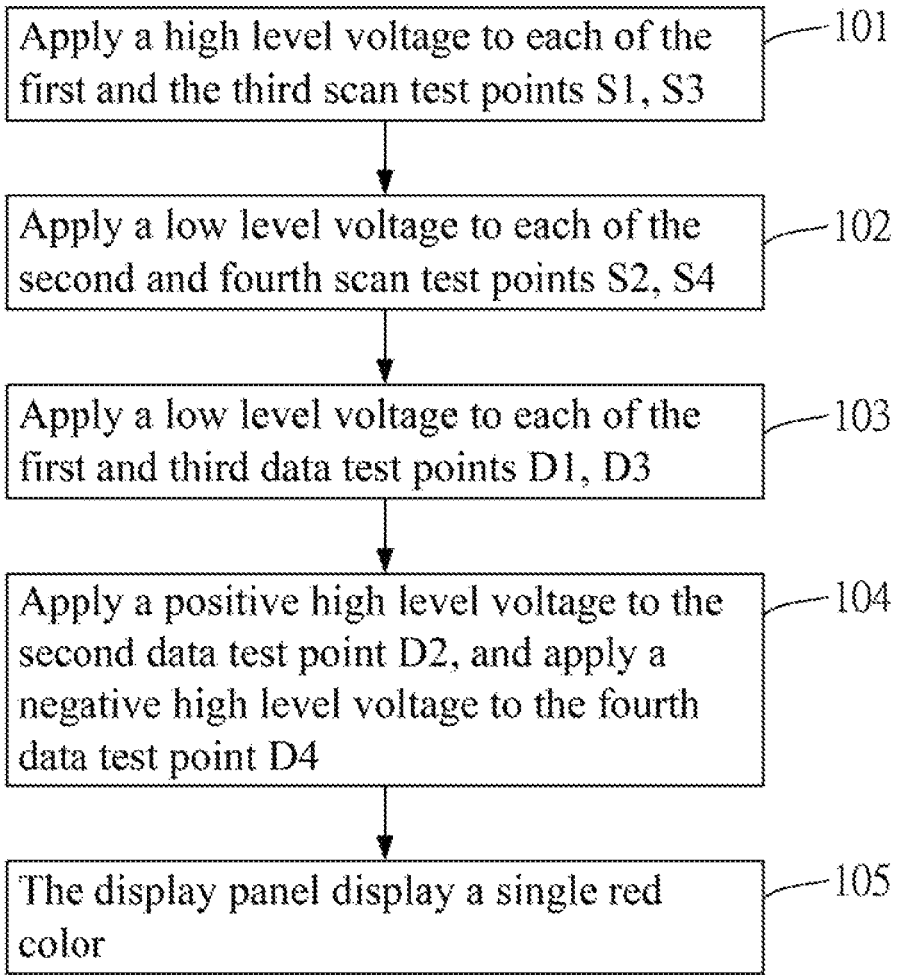
FIG. 5 is a flow chart of a method of testing signal red color image of the display panel.

FIG. 5 constitutes a flow chart of a method of testing signal red color image of the display panel. The method is provided by way of example, as there are a variety of ways to carry out the method. The method of testing signal red color image of the display panel described below can be carried out using the configurations illustrated in FIGS. 1 to 4, for example, and various elements of these figures are referenced in explaining the example method. Each block shown in FIG. 5 represents one or more processes, methods, or subroutines carried out in the example method. Furthermore, the illustrated order of blocks is by example only and the order of the blocks can be changed. Additional blocks may be added or fewer blocks may be utilized, without departing from this disclosure. The example method can begin at block 101.

At block 101, each of the first and the third scan test points S1, S3 can apply a high level voltage.

At block 102, each of the second and fourth scan test points S2, S4 can apply a low level voltage.

At block 103, each of the first and third data test points D1, D3 can apply a low level voltage.

At block 104, the second data test point D2 can apply a positive high level voltage, and the fourth data test point D4 can apply a negative high level voltage.

At block 105, the display panel can display a single red color. At that moment, the electrode of the red sub-pixel of the first pixel can be positive, and the electrode of the red sub-pixel of the second pixel can be negative. Similarly, the electrode of the red sub-pixel of the third pixel can be positive, and the electrode of the red sub-pixel of the fourth pixel can be negative. In other words, the red sub-pixels of adjacent pixels in a same row have opposite polarities.

This is similar to when the display panel 1 displays other single colors. Each of the first and third scan test points S1, S3 can apply voltages of different levels relative to a voltage applied to each of the second and fourth scan test points S2, S4. Each of the first and third data test points D1, D3 can apply voltages of different levels relative to a voltage applied to each of the second and fourth data test points D2, D4. The first and third data test points D1, D3, or the second and fourth data test points D2, D4, which apply high level voltages have opposite voltage polarities. Thus, the green sub-pixels 314 of adjacent pixels in the same row have opposite polarities, and the blue sub-pixels 316 of adjacent pixels in the same row have opposite polarities, and the white sub-pixels 318 of adjacent pixels in the same row have opposite polarities. That is, a red (green, blue, white) sub-pixel 312 (314, 316, and 318) and a neighboring red (green, blue, white) sub-pixel in the same row have opposite polarities.

By such arrangement, the coupling effects caused by capacitors (i.e., Cscs) of each two neighboring columns of the pixels 311 on the waveform of an common electrode can be offset from each other to obviate horizontal crosstalk, wherein the capacitor is a capacitor interconnecting a data line and a common electrode for supplying a bias across the liquid crystal layer 40. Flicker of the single color display can thus be reduced. The common electrode of the pixels 311 and the capacitors are well known by those skilled in the art, thus detailed descriptions thereof are omitted here.

FIG. 4 illustrates a second embodiment of a circuit 31 of the TFT array substrate 30 of the display panel 1. A structure of the TFT array substrate 30 of the second embodiment is similar to a structure of the TFT array substrate 30 of the first embodiment shown in FIG. 3. Differences in the second embodiment are as follows.

There are two data test points D1 to D4 and two scan test points S1 to S4. The two groups of the data test points D1 to D4 are respectively positioned at opposite sides horizontally of the display panel 1. The two groups of the scan test points S1 to S4 are respectively positioned at opposite sides vertically of the display panel 1.

When testing single color image of the display panel 1, a voltage can be applied by both of the two first data test points D1, by the two second data test points D2, by the two third data test points D3, and by the two fourth data test points. Such voltage can also be applied by two first scan test points S1, two second scan test points S2, two third scan test points S3, and two fourth scan test points S4. Thus, the electric current can be shared to the data test points D1 to D4 and the scan test points S1 to S4.

The embodiments shown and described above are only examples. Even though numerous characteristics and advantages of the present technology have been set forth in the foregoing description, together with details of the structure and function of the present disclosure, the disclosure is illustrative only, and changes may be made in the detail, including in particular the matters of shape, size, and arrangement of parts within the principles of the present disclosure, up to and including the full extent established by the broad general meaning of the terms used in the claims.

What is claimed is:

1. A display panel comprising:

a thin film transistor array substrate comprising:

a plurality of pixels arranged in a matrix comprising a plurality of columns and a plurality of rows, each of the plurality of pixels comprising a plurality of sub-pixels, the plurality of sub-pixels arranged in a matrix comprising a plurality of columns and a plurality of rows, the plurality of sub-pixels comprising a first sub-pixel, a second sub-pixel, a third sub-pixel, and a fourth sub-pixel arranged in a 2×2 matrix, the first sub-pixel configured to display a first color, the second sub-pixel configured to display a second color, the third sub-pixel configured to display a third color, the fourth sub-pixel configured to display a fourth color;

a plurality of data lines and a plurality of scan lines configured to drive the plurality of pixels, wherein two of the plurality of data lines are arranged between every two adjacent columns of the sub-pixels, one of the plurality of scan lines is arranged between every two adjacent rows of the sub-pixels, the sub-pixels in the same row are electrically coupled to the adjacent same scan line, the sub-pixels configured to display a same color in each column of the sub-pixels are electrically coupled to the adjacent same data line, and the sub-pixels displaying different colors in each column of the sub-pixels are electrically coupled to different data lines;

four data test points comprising a first data test point, a second data test point, a third data test point, and a fourth data test point, every two data lines which are electrically coupled to the sub-pixels of each column of the sub-pixels are coupled to a node, and four adjacent nodes are respectively electrically coupled to the four data test points; and four scan test points comprising a first scan test point, a second scan test point, a third scan test point, and a fourth scan test point, four of the plurality of scan lines respectively coupled to adjacent four rows of the sub-pixels are respectively electrically coupled to the four scan test points, wherein, every two sub-pixels which are configured to display a same color and adjacent to each other have opposite polarities.

2. The display panel of claim 1, wherein in each pixel, the first sub-pixel and the second sub-pixel are arranged in a same row, the first sub-pixel and the third sub-pixel are arranged in a same column, the second sub-pixel and the fourth sub-pixel are arranged in a same column; the first sub-pixels in each column are coupled to one of the adjacent data lines, and the third sub-pixels in each column are coupled to another one of the adjacent data lines; the second sub-pixels in each column are coupled to one of the adjacent data lines, and the fourth sub-pixels in each column are coupled to another one of the adjacent data lines.

3. The display panel of claim 2, wherein the first sub-pixel is a green sub-pixel, the second sub-pixel is a red sub-pixel, the third sub-pixel is a blue sub-pixel, the fourth sub-pixel is a white sub-pixel.

4. The display panel of claim 3, wherein each pixel further comprises a first thin film transistor, a second thin film transistor, a third thin film transistor, and a fourth thin film transistor, the first thin film transistor is coupled to the green sub-pixel, the corresponding scan line coupled to the green sub-pixel, and the corresponding data line coupled to the green sub-pixel; the second thin film transistor is coupled to the red sub-pixel, the corresponding scan line coupled to the red sub-pixel, and the corresponding data line coupled to the red sub-pixel; the third thin film transistor is coupled to the blue sub-pixel, the corresponding scan line coupled to the blue sub-pixel, and the corresponding data line coupled to the blue sub-pixel; the fourth thin film transistor is coupled to the white sub-pixel, the corresponding scan line coupled to the white sub-pixel, and the corresponding data line coupled to the white sub-pixel.

5. The display panel of claim 4, wherein each of the thin film transistors comprises a source electrode electrically coupled to the corresponding data line, a gate electrode electrically coupled to the corresponding scan line, and a drain electrode electrically coupled to a pixel electrode of the corresponding sub-pixel.

6. The display panel of claim 1, wherein the first data test point have an opposite voltage polarity relative to the third data test point, the second data test point have an opposite voltage polarity relative to the fourth data test point.

7. The display panel of claim 1, wherein the display panel is a liquid crystal display panel and further comprises a color filter, a backlight module, and a liquid crystal layer positioned above the thin film transistor array substrate, the color filter is positioned above the liquid crystal layer, the thin film transistor array substrate is positioned between the backlight module and the liquid crystal layer.

8. The display panel of claim 1, wherein the thin film transistor array substrate further comprises another four data test points and another four scan test points arranged at opposite sides of the display panel.

9. A method of testing single color image of the display panel of claim 1, comprising:

applying voltages to the scan test points, wherein the voltage applied to each of the first and third scan test points is in a different level relative to the voltage applied to each of the second and fourth scan test points;

applying voltages to the data test points, wherein the voltage applied to each of the first and third data test points is in a different level relative to the voltage applied to each of the second and fourth data test points, the first and third data test points or the second and fourth data test points which be applied with higher level voltage have opposite voltage polarities.

10. A thin film transistor array substrate comprising:

a plurality of data lines;

a plurality of scan lines substantially perpendicular to the plurality of data lines;

a plurality of pixels arranged in a matrix comprising a plurality of columns and a plurality of rows, each of the plurality of pixels comprising a plurality of sub-pixels, the plurality of sub-pixels arranged in a matrix comprising a plurality of columns and a plurality of rows, the plurality of sub-pixels comprising a first sub-pixel, a second sub-pixel, a third sub-pixel, and a fourth sub-pixel, the first sub-pixel configured to display a first color, the second sub-pixel configured to display a second color, the third sub-pixel configured to display a third color, the fourth sub-pixel configured to display a fourth color;

wherein four data test points comprises a first data test point, a second data test point, a third data test point, and a fourth data test point, two of the plurality of data lines are arranged between every two adjacent columns of the sub-pixels, one of the plurality of scan lines is arranged between every two adjacent rows of the sub-pixels, the sub-pixels in each row of the sub-pixels are electrically coupled to the adjacent same scan line, the sub-pixels configured to display a same color in each column of the sub-pixels are electrically coupled to the adjacent same data line; and the sub-pixels displaying different colors in each column of the sub-pixels are electrically coupled to different data lines, wherein every two data lines which are electrically coupled to the sub-pixels of each column of the sub-pixels are coupled to a node, and four adjacent nodes are respectively electrically coupled to the four data test points;

wherein four scan test points comprises a first scan test point, a second scan test point, a third scan test point, and a fourth scan test point, four of the plurality of scan lines respectively coupled to adjacent four rows of the sub-pixels are respectively electrically coupled to the four scan test points, wherein, every two sub-pixels which are configured to display a same color and adjacent to each other have opposite polarities.

11. The thin film transistor array substrate of claim 10, wherein in each pixel, the first sub-pixel and the second sub-pixel are arranged in a same row, the first sub-pixel and the third sub-pixel are arranged in a same column, the second sub-pixel and the fourth sub-pixel are arranged in a same column; the first sub-pixels in each column are coupled to one of the adjacent data lines, and the third sub-pixels in each column are coupled to another one of the adjacent data lines; the second sub-pixels in each column are coupled to one of the adjacent data lines, and the fourth sub-pixels in each column are coupled to another one of the adjacent data lines.

12. The thin film transistor array substrate of claim 11, wherein the first sub-pixel is a green sub-pixel, the second sub-pixel is a red sub-pixel, the third sub-pixel is a blue sub-pixel, the fourth sub-pixel is a white sub-pixel.

13. The thin film transistor array substrate of claim 12, wherein each pixel further comprises a first thin film transistor, a second thin film transistor, a third thin film transistor, and a fourth thin film transistor, the first thin film transistor is coupled to the green sub-pixel, the corresponding scan line coupled to the green sub-pixel, and the corresponding data line coupled to the green sub-pixel, the second thin film transistor is coupled to the red sub-pixel, the corresponding scan line coupled to the red sub-pixel, and the corresponding data line coupled to the red sub-pixel, the third thin film transistor is coupled to the blue sub-pixel, the corresponding scan line coupled to the blue sub-pixel, and the corresponding data line coupled to the blue sub-pixel, the fourth thin film transistor is coupled to the white sub-pixel, the corresponding scan line coupled to the white sub-pixel, and the corresponding data line coupled to the white sub-pixel.

14. The thin film transistor array substrate of claim 13, wherein each of the thin film transistors comprises a source electrode electrically coupled to the corresponding data line, a gate electrode electrically coupled to the corresponding scan line, and a drain electrode electrically coupled to a pixel electrode of the corresponding sub-pixel.

15. The thin film transistor array substrate of claim 10, wherein the first data test point have an opposite voltage polarity relative to the third data test point, the second data test point have an opposite voltage polarity relative to the fourth data test point.

16. The thin film transistor array substrate of claim 10, wherein the thin film transistor array substrate further comprises another four data test points and another four scan test points arranged at opposite sides of the display panel.

* * * * *